US008414335B2

(12) United States Patent
Yu et al.

(10) Patent No.: US 8,414,335 B2
(45) Date of Patent: Apr. 9, 2013

(54) USB PORT

(75) Inventors: Hong-Chi Yu, Kaohsiung (TW); Mao-Ting Chang, Kaohsiung (TW)

(73) Assignee: Walton Advanced Engineering Inc., Kaohsiung (TW)

( * ) Notice: Subject to any disclaimer, the term of this patent is extended or adjusted under 35 U.S.C. 154(b) by 69 days.

(21) Appl. No.: 13/067,540

(22) Filed: Jun. 8, 2011

(65) Prior Publication Data

US 2012/0178307 A1 Jul. 12, 2012

(30) Foreign Application Priority Data

Jan. 7, 2011 (TW) ..... 100100603 A

(51) Int. Cl.
*H01R 24/00* (2006.01)

(52) U.S. Cl. ..... 439/660

(58) Field of Classification Search ..... 439/660
See application file for complete search history.

(56) References Cited

U.S. PATENT DOCUMENTS

| | | | | |
|---|---|---|---|---|
| 4,824,383 | A * | 4/1989 | Lemke | 439/108 |
| 6,129,589 | A * | 10/2000 | Simmel et al. | 439/660 |
| 6,976,853 | B2 * | 12/2005 | Goto | 439/74 |
| 7,108,520 | B1 * | 9/2006 | Delaney et al. | 439/79 |
| 7,744,426 | B2 * | 6/2010 | Zheng et al. | 439/660 |
| 7,841,905 | B2 * | 11/2010 | Zheng et al. | 439/660 |
| 8,133,078 | B2 * | 3/2012 | Lin et al. | 439/660 |
| 2005/0085133 | A1 * | 4/2005 | Wang et al. | 439/660 |
| 2010/0303421 | A1 * | 12/2010 | He et al. | 385/75 |

* cited by examiner

*Primary Examiner* — Gary F. Paumen
(74) *Attorney, Agent, or Firm* — Bacon & Thomas, PLLC

(57) ABSTRACT

The present invention provides a USB port comprising a support pad for the support pad's both first surface and second surface compatible to the data transfer interface of the USB Series A male connector and plugged into a female socket for fewer costs spent in purchasing any device attributed to any damaged USB port or female socket in the past and a USB port plugged along a restricted direction.

8 Claims, 7 Drawing Sheets

USB PORT

BACKGROUND OF THE INVENTION

1) Field of the Invention

The present invention relates to a USB port, especially to a USB port plugged into a computer's slot or any other electronic device's USB port in both ways.

2) Description of the Prior Art

A variety of connecting structures designed in data transfer interfaces have been extensively applicable to lots of electronic devices such as Universal Serial Bus (USB), micro-USB, mini-USB, etc. and known to users with development of the electronic industry.

For instance, the Universal Serial Bus (USB) data transfer interface featuring multiple advantages of hot swap, plug-and-play, fast transfer speed, and portability has become a basic interface of many electronic peripheral devices including keyboard, mouse, printer, scanner, external storage device, digital camera, etc.

However, referring to FIGS. 1, 2, 3, 4 and 5 which illustrate a USB Series A male connector 5 electrically connected to a USB Series A female socket 6 wherein the male connector 5 comprises a metal connector housing 51 used to cover a support pad 52. The connector housing 51 contacts with three sides of the support pad 52; the support pad 52 supports a plurality of metal contacts 53 at its top; a gap 54 prepared between the metal contact 53 and the connector housing 51 allows a support pad 62 of the female socket 6 to be accommodated inside and a plurality of metal contacts 63 on the support pad 62 of the female socket 6 to be electrically connected to the metal contacts 53 of the male connector 5. In this regard, the support pad 52 of the male connector 5 is usually manufactured in white ceramics, black hard plastic or another robust support pad. Additionally, the female socket 6 could be one part of a computer, a PC, or a host computer system or a device connected to a host computer system via one cable.

For a USB Series A male connector 5 to be electrically plugged into a USB Series A female socket 6, the gap 54 of the male connector 5 should be opposite to the support pad 62 of the female socket 6 for a complete electric connection between two parts thereof. Another connection of the support pad 52 of the male connector 5 opposite to the support pad 62 of the female socket 6 may disable the electric connection between two parts thereof and easily cause any damage to the support pad 52 of the male connector 5 or the support pad 62 of the female socket 6 or even a poor electric connection between the metal contacts 53 of the connector 5 and the metal contacts 63 of the female socket 6 and finally the male connector 5 or the female socket 6 damaged.

Accordingly, a data transfer interface's male connector needs to be changed structurally without any damage of a male connector or a female socket in the direction of plugging a male connector into a female socket.

SUMMARY OF THE INVENTION

To solve the said problems, the present invention provides a USB port plugged into a computer's USB Series A female socket and comprising a support pad wherein the support pad has a first surface and a second surface with which a specific plurality of metal contacts electrically contact and the metal contacts sink into the first surface and the second surface, respectively.

As a result, the principal object of the present invention is to deliver a USB port's first surface and second surface provided with a plurality of metal contacts electrically contacting a female socket and effective in being plugged into a female socket.

The other object of the present invention is to reduce any cost to purchase a new device attributed to any damage of a USB port or a female socket and a USB port plugged into the female socket along a restricted direction.

In order to achieve the purposes hereinbefore, the present invention has the principal technical measures delivered with the technical schemes as follows. The present invention as a USB port comprises a support pad with a first surface and a second surface wherein the first surface and the second surface are provided with a plurality of metal contacts respectively; the metal contacts sink into the first surface and the second surface, respectively; the metal contacts installed on the first surface are opposite to the metal contacts of the second surface for an electric connection.

The objects and the technical issues with respect to the present invention are further delivered with the following technical measures.

In the said USB port, the height of the support pad is not more than an accommodating space under the USB Series A female socket.

In the said USB port, the metal contacts are separately installed in a plurality of recesses of the first surface.

In the said USB port, the metal contacts are separately installed in a plurality of recesses of the second surface.

In the said USB port, the recess is developed to be an opening narrow internally and wide externally with the maximum width greater than the width of a metal contact of the USB Series A female socket.

In the said USB port, the recess is developed to be an opening narrow internally and wide externally with the maximum width greater than the width of a metal contact of the USB Series A female socket.

In the said USB port, the support pad is installed in a case in which there are two opposite spaces located at the support pad's top and bottom respectively.

In the said USB port, the opposite space has the height which is similar to the height of a carrier of the USB Series A female socket.

In the said USB port, the support pad is a folding structure in which the support pad is developed to a first folding section and a second folding section for the metal contacts distributed on a first surface of the first folding section and a first surface of the second folding section, respectively.

In the said USB port, the metal contacts are distributed on a second surface of the first folding section and a second surface of the second folding section, respectively.

In contrast to the prior arts, the present invention is effective in each of both surfaces (the USB port's first surface or second surface) plugged into a female socket without more costs spent in purchasing any device attributed to any damaged USB port or female socket and a USB port plugged along a restricted direction.

BRIEF DESCRIPTIONS OF THE DRAWINGS

DETAILED DESCRIPTIONS OF THE PREFERRED EMBODIMENTS

In order to ensure purposes, characteristics, and effects of the present invention substantially understood, some preferred embodiments in regard to the present invention are particularly specified as follows.

Referring to FIG. 6 to FIG. 10 which illustrate the first embodiment for the present invention of a USB port 1 plugged into a USB Series A female socket 41 of a computer 4.

Figure 1:
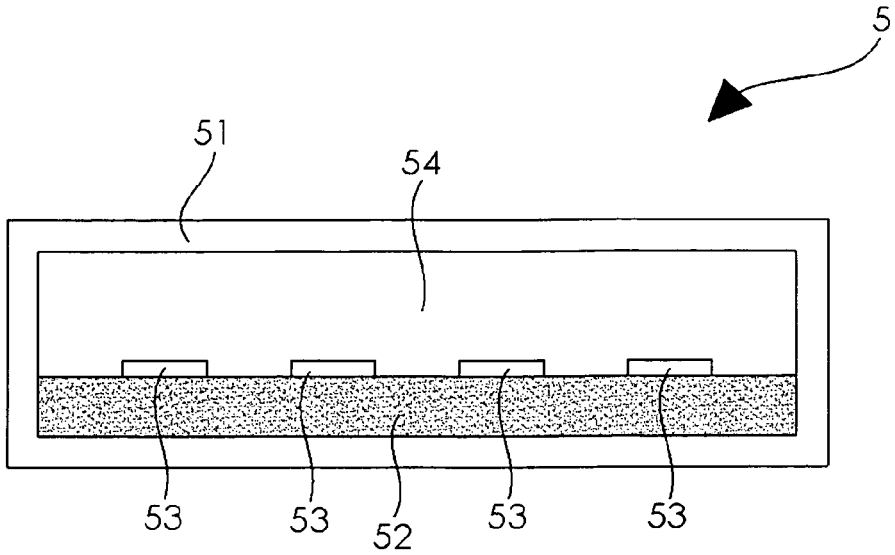
FIG. 1 is one sectional view of a USB Series A male connector.
Figure 2:
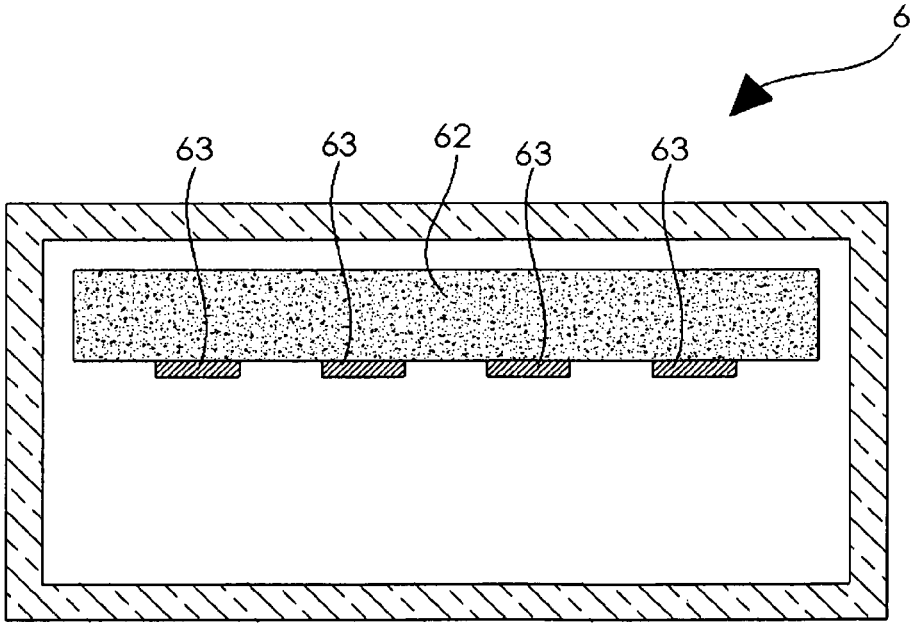
FIG. 2 is one sectional view of a USB Series A female socket.
Figure 3:
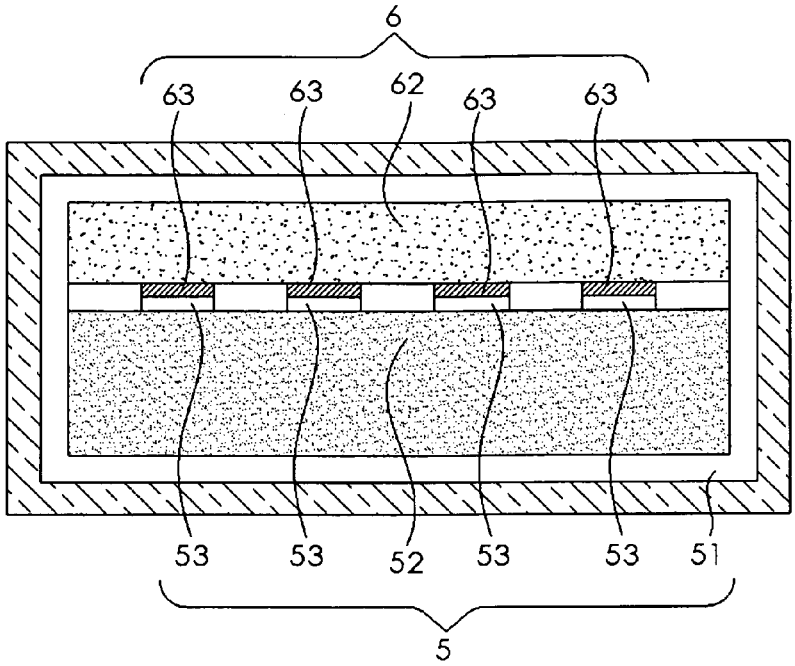
FIG. 3 is one sectional view of a USB Series A male connector and a USB Series A female socket connected each other.
Figure 4:
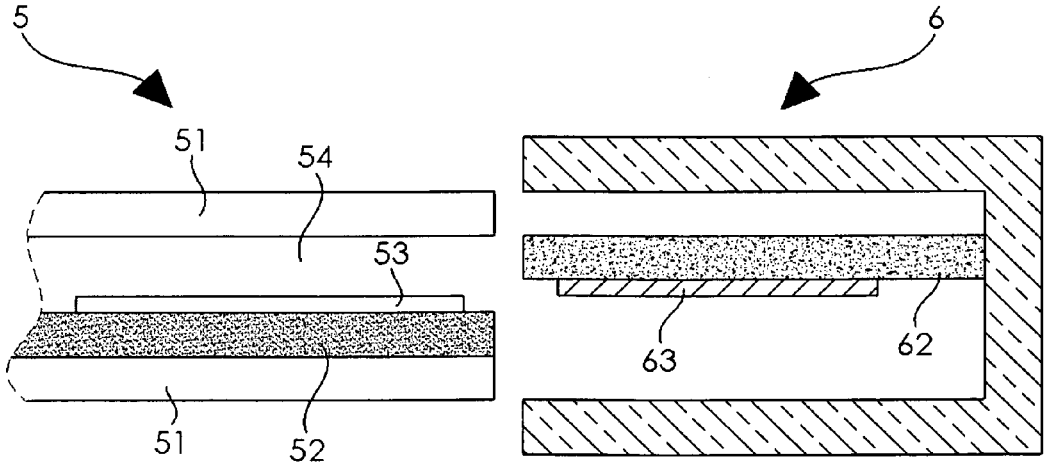
FIG. 4 is one sectional view of a USB Series A male connector and a USB Series A female socket prior to connection.
Figure 5:
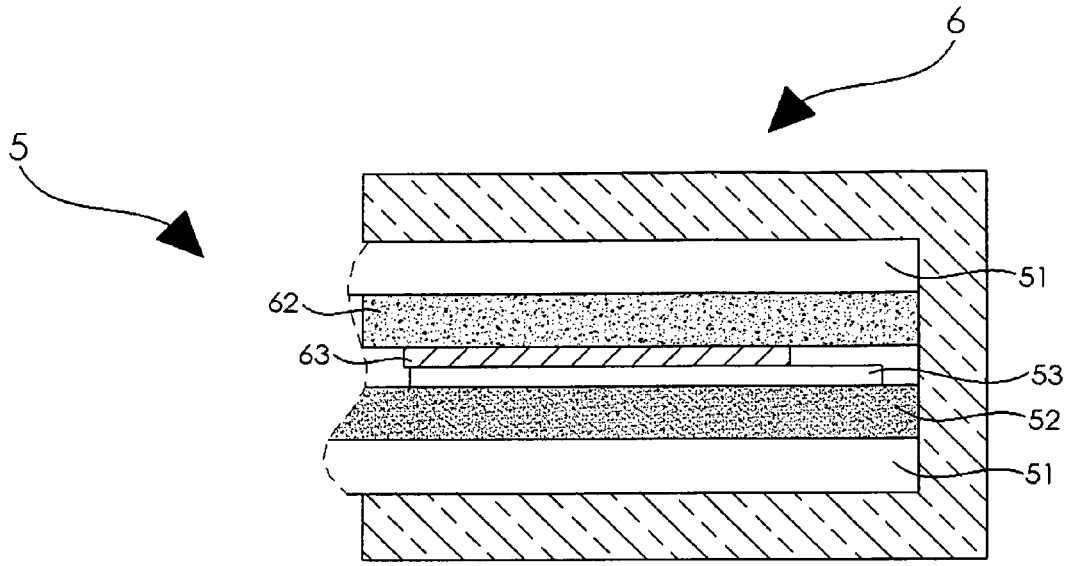
FIG. 5 is another sectional view of a USB Series A male connector and a USB Series A female socket connected each other.
Figure 6:
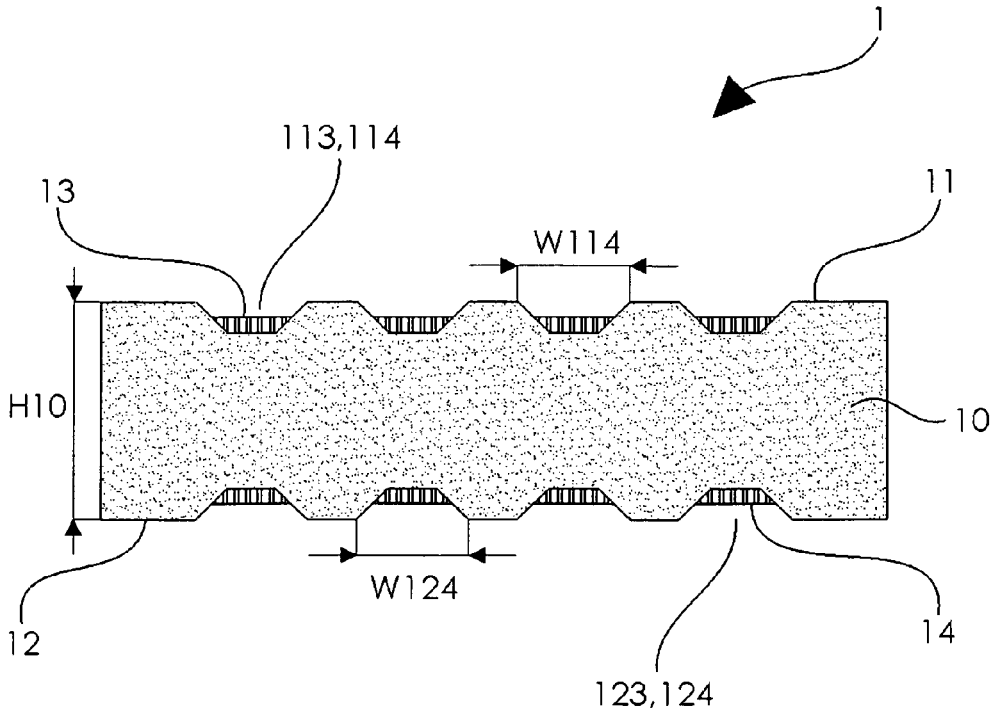
FIG. 6 is one sectional view of the first embodiment of the present invention.
Figure 7:
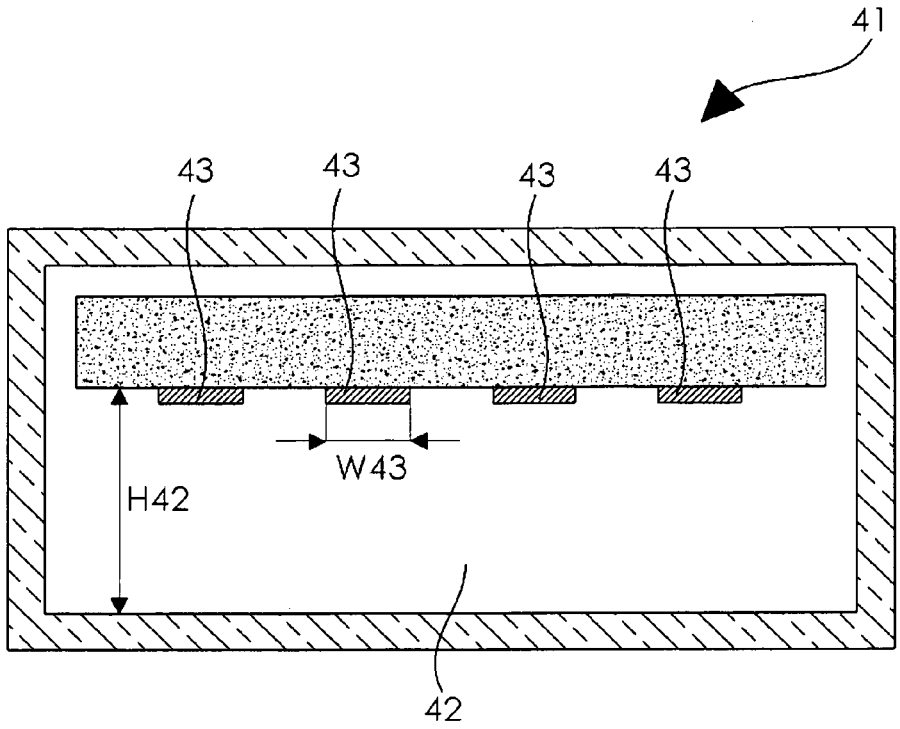
FIG. 7 is one sectional view of a USB Series A female socket.
Figure 8:
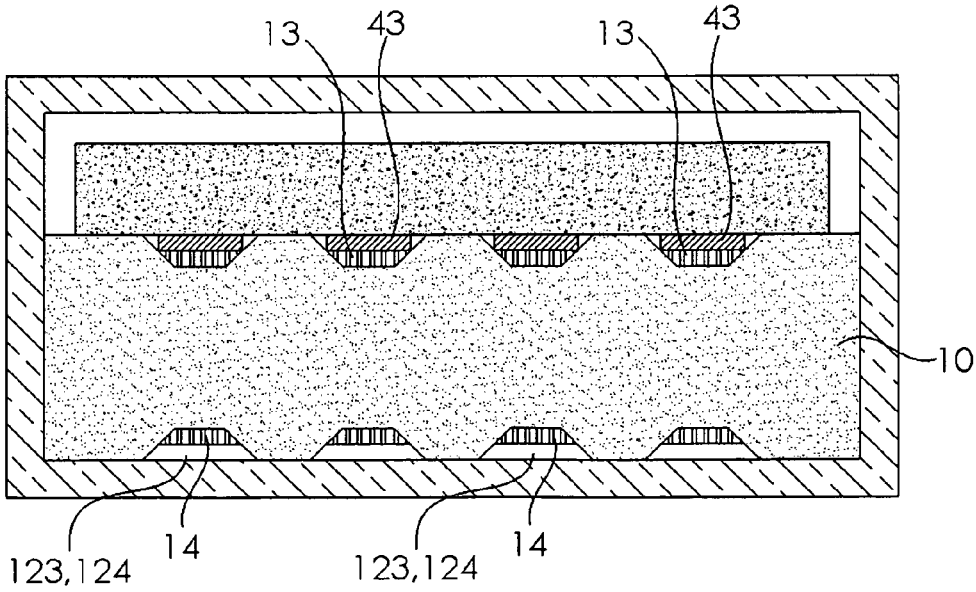
FIG. 8 is one sectional view of the first embodiment for the present invention plugged into a USB Series female socket.
Figure 9:
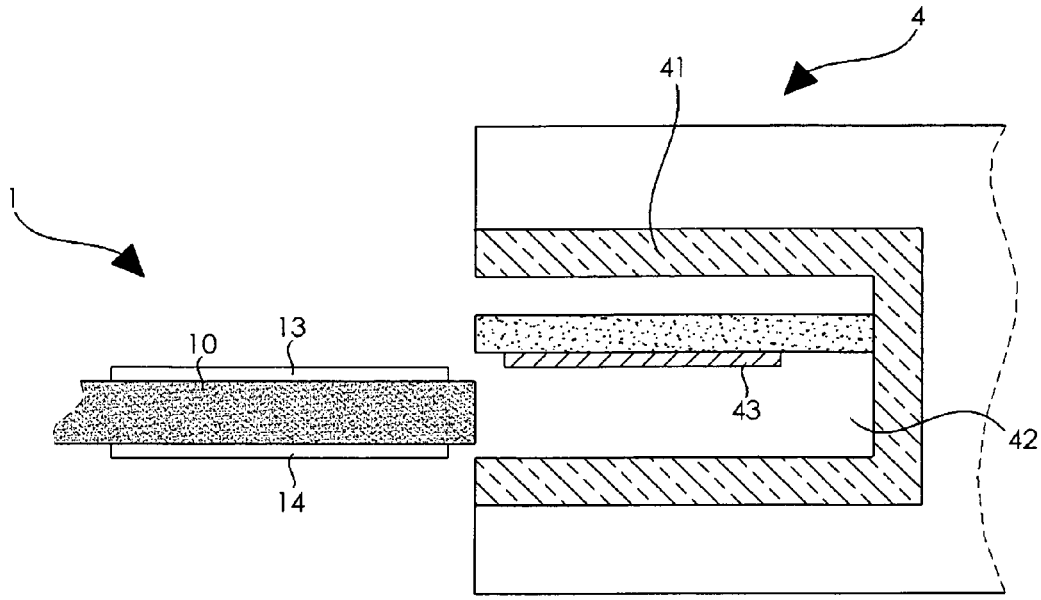
FIG. 9 is one sectional view of the first embodiment for the present invention and a USB Series A female socket before connection.
Figure 10:
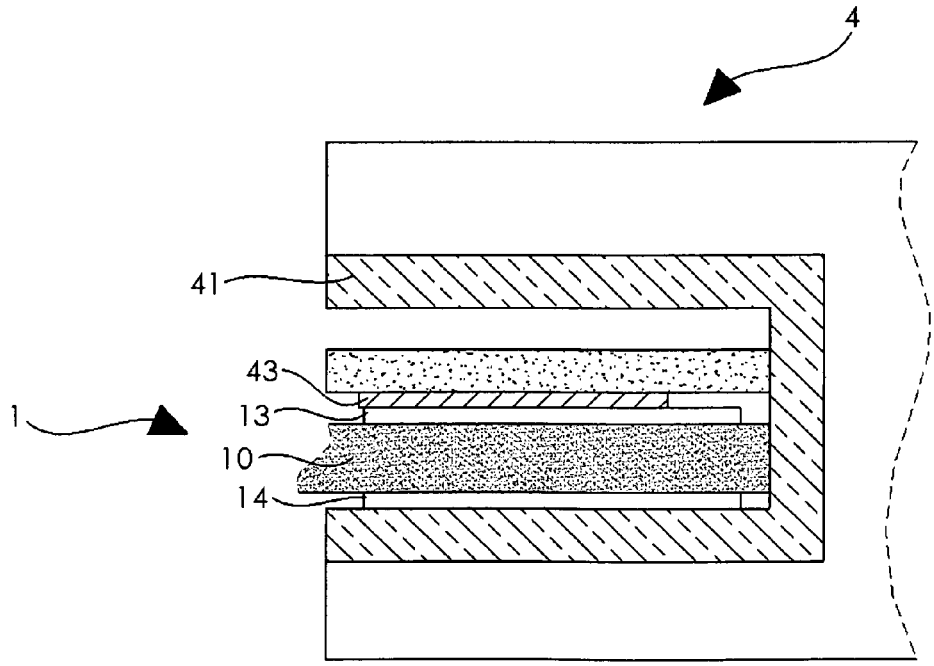
FIG. 10 is another sectional view of the first embodiment for the present invention and a USB Series A female socket connected each other.
Figure 11:
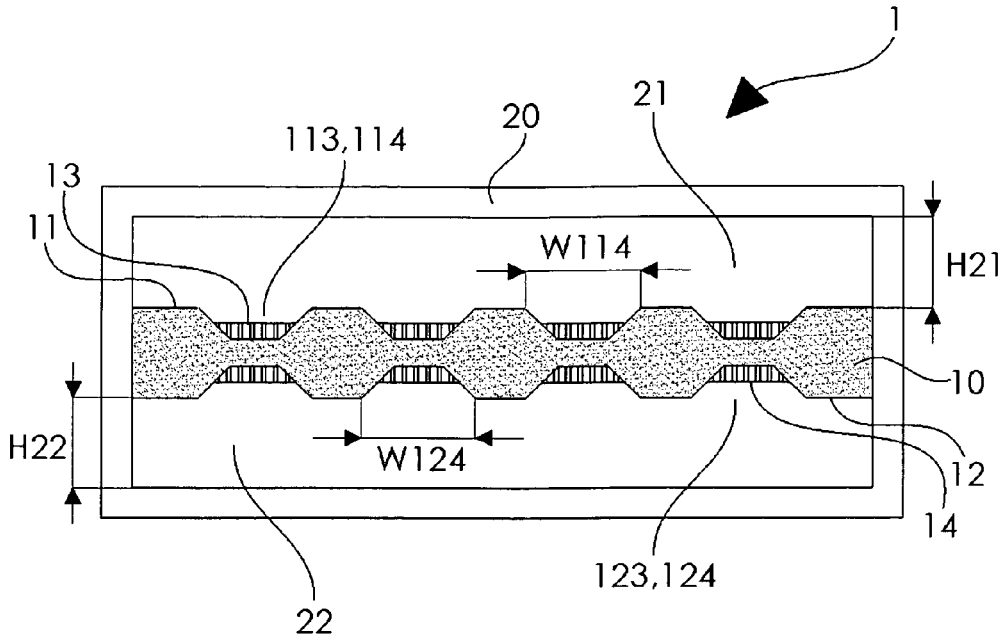
FIG. 11 is one sectional view of the second embodiment of the present invention.
Figure 12:
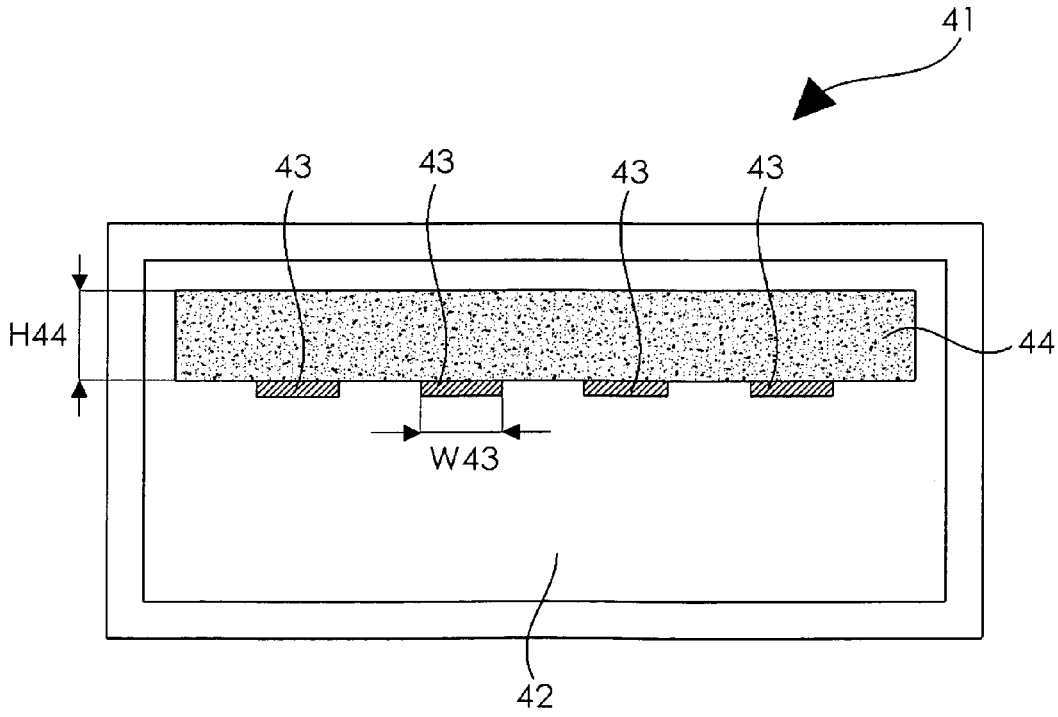
FIG. 12 is one sectional view of a USB Series A female socket.
Figure 13:
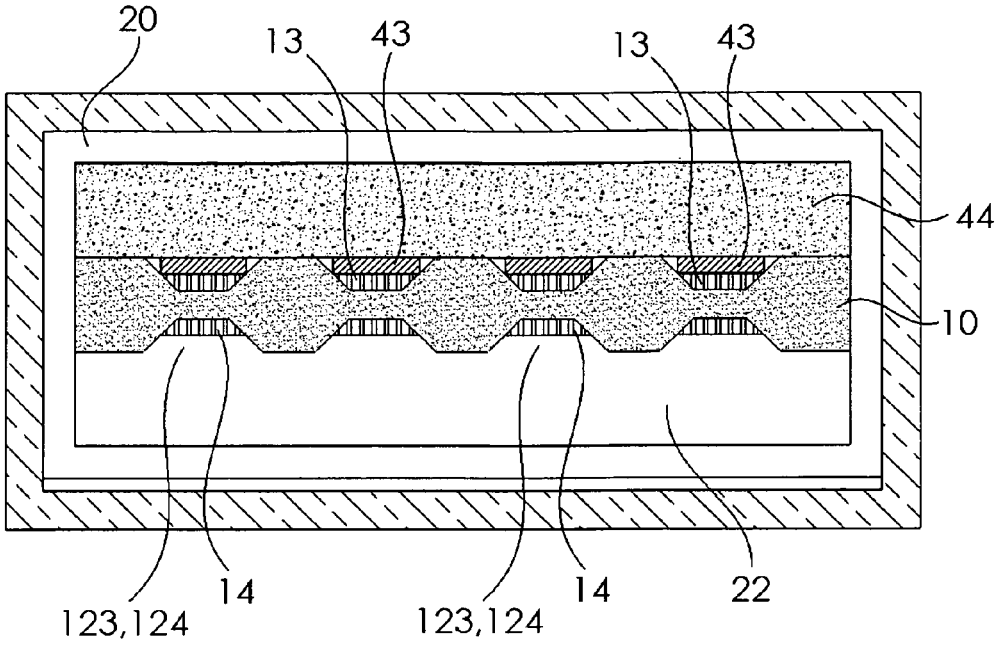
FIG. 13 is one sectional view of the second embodiment for the present invention plugged into a USB Series female socket.

Referring to FIG. 6 first which illustrates a support pad 10 with a first surface 11 and a second surface 12 wherein the first surface 11 and the second surface 12 are provided with a plurality of metal contacts 13 and a plurality of metal contacts respectively. Furthermore, both the metal contacts 13 installed on the first surface 11 and the metal contacts 14 installed on the second surface 12 are compatible to the data transfer interface of the USB (Universal-Serial-Bus) Series A male connector.

Specifically, the metal contacts 13 and the metal contacts 14 sink into the first surface 11 and the second surface 12 respectively; additionally, the metal contacts 13 installed on the first surface 11 are opposite to the metal contacts 14 installed on the second surface 12 for an electric connection.

Preferably, the metal contacts 13 are separately installed into a plurality of recesses 113 on the first surface 11, and the recess 113 is developed to be an opening 114 narrow internally and wide externally with the maximum width W114 greater than the width W43 of the metal contact 43 of the USB Series A female socket 41.

Preferably, the metal contacts 14 are separately installed into a plurality of recesses 123 on the second surface 12, and the recess 123 is developed to be an opening 124 narrow internally and wide externally with the maximum width W124 greater than the width W43 of the metal contact 43 of the USB Series A female socket 41.

Referring to FIG. 6 to FIG. 10 which illustrate the height H10 of the support pad 10 is not more than the height H42 of an accommodating space 42 under the USB Series A female socket 41. In view of the metal contacts 13 (metal contacts 14), which are compatible to the USB Series A male connector, installed on the first surface 11 (second surface 12) of the support pad 10, the support pad 10 has its both surfaces (first surface and second surface) electrically connected to an accommodating space 42 under the USB Series A female socket 41; additionally, the present invention also contributes to fewer costs spent in purchasing any device attributed to any damaged USB port or female socket in the past and a USB port plugged into a female socket along a restricted direction.

Referring to FIG. 10 to FIG. 13 which illustrate the second embodiment of the present invention wherein the structural features from FIG. 10 to FIG. 13 identical to those of the first embodiment and from FIG. 6 to FIG. 10 are designated by the same characters or not repeatedly described herinafter. The second embodiment different from the first one is the support pad 10 installed inside a case 20 in which there are two opposite spaces 21,22 developed on the top of the support pad 10 (for the opposite space 21) and the bottom of the support pad 10 (for the opposite space 22), respectively.

Specifically, the height H21 of the opposite space 21 or the height H22 of the opposite space 22 is similar to the height H44 of a carrier 44 of the USB Series A female socket 41. When the metal contacts 13 on the first surface 11 of the support pad 10 are electrically connected to the metal contacts 43 on the USB Series A female socket 41, three inner surfaces of the case corresponding to the opposite space 21 are securely accommodated in the carrier 44 of the female socket 41 and consequently contribute to the case 20 stably plugged and protecting the support pad 10.

The characteristics of the metal contacts 14 on the second surface 12 of the support pad 10 will not be repeatedly explained herein in virtue of their functions for electric connection identical to those of the metal contacts 13 on the first surface 11 of the support pad 10.

Figure 14:
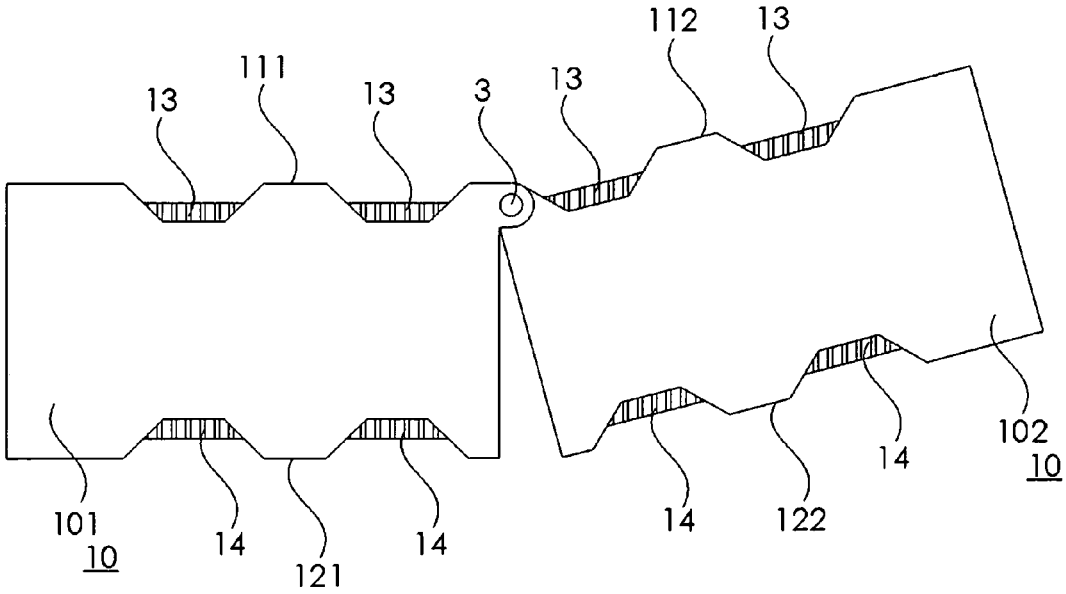
FIG. 14 is one sectional view of the third embodiment of the present invention.

Referring to FIG. 14 which illustrates the third embodiment of the present invention wherein the structural features in FIG. 14 identical to those of the first embodiment and from FIG. 6 to FIG. 10 are designated by the same characters or not repeatedly described hereinafter.

The third embodiment different from the first one is the support pad 10 developed to be a folding structure with a first folding section 101 and a second folding section 102 wherein the metal contacts 13 are distributed on a first surface 111 of the first folding section 101 and a first surface 112 of the second folding section 102, and the metal contacts 14 are distributed on a second surface 121 of the first folding section 101 and a second surface 122 of the second folding section 102. Specifically, both the metal contacts 13 and the metal contacts 14 are compatible to the data transfer interface of the USB Series A male connector. Preferably, the folding structure of the first folding section 101 and the second folding section 102 is constituted by multiple ways including but not limited to a plug structure 3, a clasp (not shown in figures), a magnet (not shown in figures) or adhesive (not shown in figures) for the embodiment matching the design philosophy emphasizing a light, thin, short, and small device and integrated with other relevant products to deliver this multi-functional compound product.

The present invention provides a USB port comprising a support pad for the support pad's first surface and second surface compatible to the data transfer interface of the USB Series A male connector and plugged into a female socket with minimum costs spent in purchasing any device attributed to any damaged USB port or female socket in the past and a USB port plugged along a restricted direction.

Each of the first embodiment, the second one, and the third one herein should not been regarded as an example to restrict the present invention, and any change or modification made by any skilled person based on the embodiments thereof without departing from the spirit and nature of the present invention or the content of the appended claims and drawings is still within the technical scope of the present invention which is referred to the claims hereinafter.

Accordingly, the present invention with its effects different from general conventional USB ports and referred to as creative work among products with a similar structure meets patentability and is applied for the patent.

What is claimed is:

1. A USB port plugged into a USB Series A female socket of a computer and comprising:

a support pad with a first surface and a second surface wherein the first surface and the second surface are provided with a plurality of metal contacts and a plurality of metal contacts respectively;

the metal contacts and the metal contacts sink into the first surface and the second surface respectively; and the metal contacts installed on the first surface correspond to the metal contacts;

wherein the support pad is a folding structure having a first folding section and a second folding section, and the metal contacts are distributed on a first surface of the first folding section and on a first surface of the second folding section; and wherein the metal contacts are distributed on a second surface of the first folding section and on a second surface of the second folding section.

2. The USB port according claim 1 wherein the height of the support pad is not more than an accommodating space under a USB Series A female socket.

3. The USB port according claim 1 wherein the metal contacts are separately installed in a plurality of recesses on the first surface.

4. The USB port (1) according claim 1 wherein the metal contacts (14) are separately installed in a plurality of recesses (123) on the second surface (11).

5. The USB port according claim 3 wherein the recess is developed to be an opening narrow internally and wide externally with the maximum width greater than the width of a metal contact in a USB Series A female socket.

6. The USB port according claim 4 wherein the recess is developed to be an opening narrow internally and wide externally with the maximum width greater than the width of a metal contact in a USB Series A female socket.

7. The USB port according claim 1 wherein the support pad is installed in a case in which there are two opposite spaces developed on the top and the bottom of the support pad, respectively.

8. The USB port according claim 7 wherein the height of the opposite space is similar to the height of a carrier of the USB Series A female socket.

* * * * *